United States Patent [19]

Moore et al.

[11] Patent Number: 4,991,414

[45] Date of Patent: Feb. 12, 1991

[54] LOCKABLE HANDLE

[75] Inventors: Joseph Moore; Roger W. Tasker, both of Brighouse, United Kingdom

[73] Assignee: Window Machinery Sales Limited, West Yorkshire, United Kingdom

[21] Appl. No.: 438,392

[22] PCT Filed: Jun. 24, 1988

[86] PCT No.: PCT/GB88/00489

§ 371 Date: Dec. 21, 1989

§ 102(e) Date: Dec. 21, 1989

[87] PCT Pub. No.: WO88/10350

PCT Pub. Date: Dec. 29, 1988

[30] Foreign Application Priority Data

Jun. 24, 1987 [GB] United Kingdom ..... 8714726

[51] Int. Cl.[5] ..... E05B 13/10

[52] U.S. Cl. ..... 70/215; 70/360

[58] Field of Search ..... 70/360, 215, 217, 224, 70/197, 216, 210, DIG. 20, DIG. 27, DIG. 31

[56] References Cited

U.S. PATENT DOCUMENTS

| | | | |
|---|---|---|---|
| 1,247,532 | 11/1917 | Heath | 70/215 X |
| 2,358,554 | 9/1944 | Bixel | 70/215 |
| 3,668,906 | 6/1972 | Josephart | 70/360 X |
| 4,009,599 | 3/1977 | Patriquin | 70/360 X |
| 4,565,080 | 1/1986 | Kincaid et al. | 70/360 X |

FOREIGN PATENT DOCUMENTS

| | | | |
|---|---|---|---|
| 2538942 | 3/1977 | Fed. Rep. of Germany . | |
| 2910295 | 9/1980 | Fed. Rep. of Germany | 70/215 |
| 2105774 | 3/1983 | United Kingdom . | |

*Primary Examiner*—Lloyd A. Gall

*Attorney, Agent, or Firm*—Shoemaker and Mattare, Ltd.

[57] ABSTRACT

A lockable handle assembly includes a handle supported on a backplate, with a lock body retained in a slideway in the head of the handle. The lock body has a protruding first pin which engages within the back plate in a locking position, and a second pin which travels along a second recess. A biasing spring is retained against the second pin.

2 Claims, 2 Drawing Sheets

FIG.1.

LOCKABLE HANDLE

BACKGROUND OF THE INVENTION

1. Field of the Invention

This invention relates to a lockable handle, particularly, but not exclusively for fitting to uPVC windows and the like in which a square bar of the handle operates drive gear within the window frame that extends or retracts locking cams.

Particularly where the handle is of relatively compact dimensions the provision of a key operated internal lock has presented problems, because standard barrel locks are too large to fit satisfactorily.

2. Description of the Prior Art

In U.S. Pat. No. 2,358,554 (Bixel) and GB Patent No. 2,105,774 (Narcros) there are described lockable handle assemblies in which a handle pivoted to a backplate carries a lock body slideably retained in a head region of the handle for movement to the backplate to cause a depending locking pin fixed to the lock body to enter an aperture in the backplate to hold the handle against pivotal movement. In this movement, a latch member in the lock body snaps into a recess in the slideway to hold the handle locked and a coil spring coaxial with the locking pin and located beneath the lock body is compressed. Operation of a key operated lock barrel causes the latch member to be withdrawn so that the spring returns the lock body to its unlocking position.

SUMMARY OF THE INVENTION

A primary object of the invention is to provide a lockable handle which, while operating approximately in the same way as the above prior proposals, is more simple in structure, cheaper to manufacture and essentially much neater in appearance rendering it satisfactory for living rooms and so forth.

According to the present invention, a lockable handle assembly comprises a backplate for fixing to a member to which the handle is to be locked, a handle member having a head region pivotally mounted about an axis normal to said backplate and a grip region offset from said backplate and extending radially from said head region. The head region has a lower face substantially in contact with the backplate, a lock body of noncircular shape when viewed in plan slidably retained in a slideway formed in the head region between the axis and the grip region for movement towards and away from the backplate, a depending locking pin fixed to the lock body, the backplate being formed with an aperture for receiving the locking pin when the lock body is moved along the slideway to a locking position thereby holding the handle against pivotal movement. The slideway is formed with a smooth region leading to a first recess beneath the smooth region, a biased latch member mounted to reciprocate in the lock body and arranged for one end of the latch member to slide over the smooth region as the lock body is moved towards the locking position to a position in which it snaps into the first recess to hold the lock body in the locking position, a key operated lock barrel rotatably mounted in the lock body with its key receiving end exposed in the surface of the lock body remote from the backplate and operative to withdraw the latch member from the recess, a return spring biasing the lock body away from the locking position whereby the required locking effect may be obtained by manually moving the lock body against the biasing spring towards said locking position and may be released by the actuation of the key operated lock barrel. The assembly is characterized in that the slideway is formed laterally with a second recess extending from an end facing towards the backplate by a distance at least equal to the travel of the lock body in the slideway, and a second pin fixed to the lock body in a position to travel therewith along the second recess and a retaining member fixed to the head region and operative to retain the biasing spring between itself and the second pin.

The difficulty is solved, according to the invention, by providing a handle assembly comprising a handle member pivoted to a backplate, a lock slideably retained in the handle for movement towards or away from the backplate to engage depending locking pin means carried thereby in a recess in the backplate and thereby obtain a required locking effect simply by such movement, and secondary latch means operable on manual depression of the lock to latch the lock in a position lowered towards the baseplate until disengaged by operation of key operated release means.

BRIEF DESCRIPTION OF THE DRAWINGS

An embodiment of the invention will now be described, by way of example only, with reference to the accompanying drawings, in which.

DESCRIPTION OF THE PREFERRED EMBODIMENT

Figure 1:
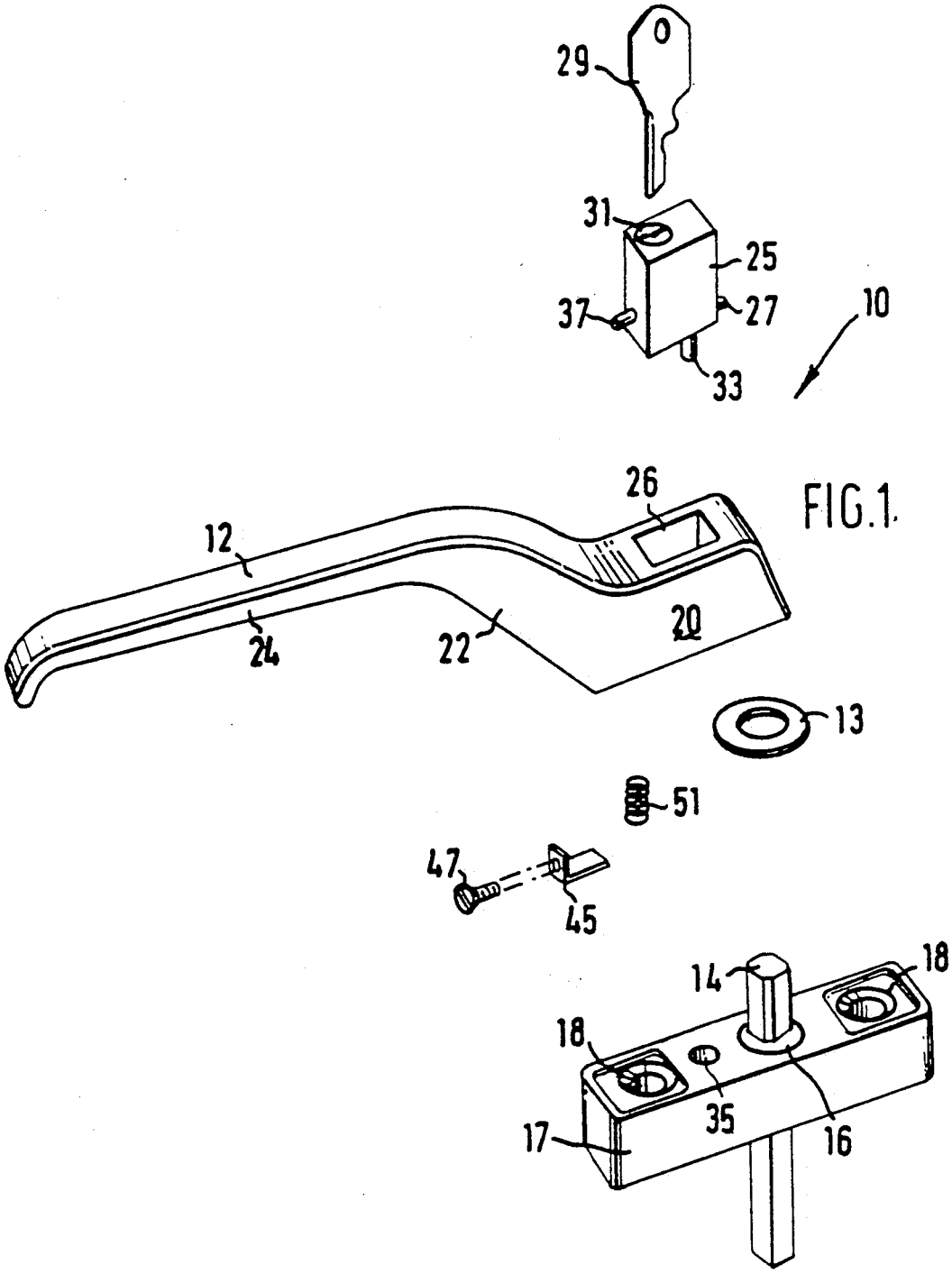
FIG. 1 is an exploded view of a locking espagnolette handle assembly according to the invention.

In FIG. 1 an espagnolette handle assembly 10 comprises a handle member 12 that is attached to a square spindle member 14 with an intervening plastics washer 13 which is rotationally supported, e.g. in a sleeve in an aperture 16 of a backplate 17 having through-holes 18 for attachment to an open-out top or side hung window or door of uPVC. The handle 12 has a head region 20 adjacent the backplate 17 that is joined by a transition region 22 to an offset grip region 24, and an object of the invention is to fit a key operated lock into the restricted available space in the head region 20 between the spindle member 14 and the transition region 22. The problem of space is particularly acute in backplates and handles of width about 16 mm or less which are needed for the smaller sizes of uPVC extrusions.

Figure 2:
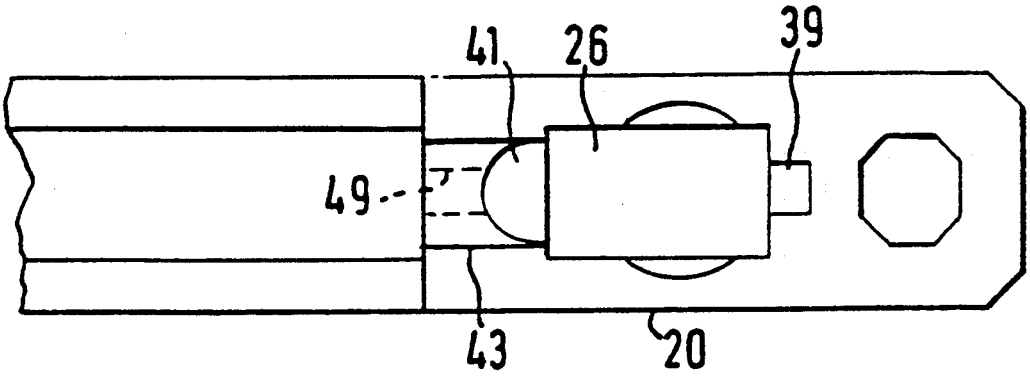
FIG. 2 is an underneath view of a handle member forming part of the assembly of FIG. 1 with the lock removed.
Figure 3:
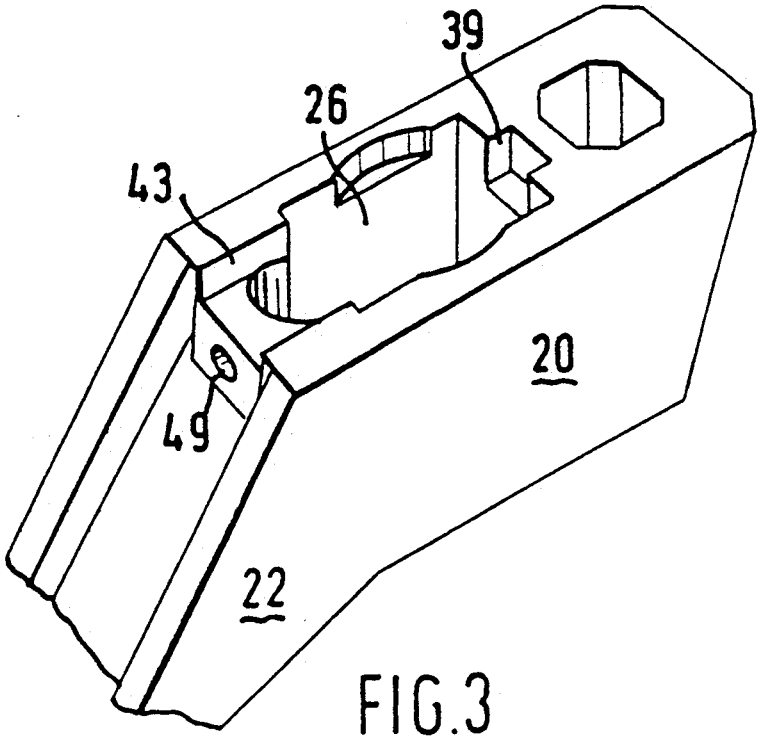
FIG. 3 is a scrap perspective view of the underside of the handle.

The problem is solved, according to the invention, by providing a lock 25 that is of retangular or other noncircular shape when viewed in plan and fits into a corresponding slideway 26 formed in the head region 20 normal to the backplate 17. The lock 25 has a forwardly facing spring-loaded latch pin 27, that is retractable on insertion of a key 29 into a lock barrel 31 and on rotation of the barrel 31, a depending locking pin 33, that when the handle 12 is aligned with the backplate 17, registers with a catch recess 35, and a rearwardly facing pin 37. As may be seen in FIG. 2, the slideway 26 is bounded by a forward recess 39 into which the pin 27 fits and that is relatively shallow and a rearward recess 41 into which the pin 37 fits and that is relatively deep. The recesses 39, 41 are directed normally away from the back plate 17 and extend part way only through the head region 20. Recess 41 is bounded by cut-away region 43 into which there fits an angular cover plate 45 held in place by a retaining screw 47 that fits into bore 49. A coil spring 51 fits in compression between the pin 37 and the cover plate 45. The lock 25 is trapped in the handle 12 by abutment of the pin 37 with a closed upper end of the recess 41, towards which it is urged by the coil spring 51. At this upper position the latch pin 27 is held retracted into the body of the lock 25 because it is in register with a plain region of the slideway 26 above recess 39. The top face of the lock 25 protrudes above the body region 20 at his upper position. Finger pressure on the lock 25 depresses the lock against the resistance of spring 51, bringing the latch pin 27 into register with the recess 39 into which it is snapped outwardly because of its spring loading. The lock 25 is then retained by latch pin 27 in a lower position in which assuming that handle 12 is correctly aligned with backplate 17, the locking pin 33 is within the recess 35 and the handle 12 is prevented from rotating relative to the backplate 17. Release of the handle 12 is effected by inserting key 29 into barrel 31 and rotating the barrel 31 so that latch pin 27 is retracted from the recess 39 and the lock 25 is snapped from its lower to its upper position by action of the coil spring 51, freeing pin 33 from recess 35.

It will thus be seen that the handle 12 and backplate 17 are provided with a sliding lock having a vertical line of action and which is movable by finger pressure from an upper release position to a lower locking position in which it is held by second latching means until released by insertion of key 29 into barrel 31 and rotation of the barrel 31.

We claim:

1. A lockable handle assembly comprising a backplate for fixing to a member to which the handle is to be locked, a handle member having a head region pivotally mounted about an axis normal to said backplate and a grip region offset from said backplate and extending radially from said head region, said head region having a lower face substantially in contact with said backplate, a lock body of non-circular shape when viewed in plan slidably retained in a slideway formed in said head region between said axis and said grip region for travel towards and away from said backplate, a depending locking pin fixed to said lock body, said backplate being formed with an aperture for receiving said locking pin when said lock body is moved along said slideway to a locking position thereby holding said handle against pivotal movement, and said slideway being formed with a smooth region leading to a first recess beneath said smooth region, a biased latch member mounted to reciprocate in said lock body and arranged for one end of said latch member to slide over said smooth region as said lock body is moved towards said locking position to a position in which it snaps into said first recess to hold said lock body in said locking position, a key operated lock barrel rotatably mounted in said lock body with its key receiving end exposed in the surface of said lock body remote from said backplate and operative to withdraw said latch member from said recess, a return spring biasing said lock body away from said locking position whereby the required locking effect may be obtained by manually moving said lock body against said biasing spring towards said locking position and may be released by the actuation of said key operated lock barrel, said slideway being formed laterally with a second recess extending from an end facing towards said backplate by a distance at least equal to the travel of said lock body in said slideway, a second pin fixed to said lock body in a position to travel therewith along said second recess and said second pin engaged by said return spring, and a retaining member fixed to said head region and operative to retain said biasing spring between itself and said second pin.

2. An assembly according to claim 1, wherein said head region is formed in a flat lower surface with an undercut region into which said second recess opens at its lower end, said undercut region being formed to open on one side of said head region beneath said grip region, and said retaining member being arranged to be fixed at the top of said undercut region, the assembly further comprising fixing means accessible beneath said grip region when said handle member is in an operative position for fixing said retaining member at the top of said undercut region.

* * * * *